United States Patent [19]

Asick et al.

[11] 4,337,989

[45] Jul. 6, 1982

[54] ELECTROMAGNETIC SHIELDED CONNECTOR

[75] Inventors: John C. Asick, Harrisburg; John M. Landis, Lemoyne; Leon T. Ritchie, Mechanicsburg, all of Pa.

[73] Assignee: AMP Incorporated, Harrisburg, Pa.

[21] Appl. No.: 154,162

[22] Filed: May 28, 1980

[51] Int. Cl.[3] ..... H01R 13/506; H01R 13/648

[52] U.S. Cl. ..... 339/143 R; 174/35 C

[58] Field of Search ..... 339/143 R; 174/35 C

[56] References Cited

U.S. PATENT DOCUMENTS

| | | | |
|---|---|---|---|
| 2,169,962 | 8/1939 | Del Camp | 339/143 R |
| 3,056,942 | 10/1962 | Carbaugh et al. | 339/92 |
| 3,864,011 | 2/1975 | Huber | 339/103 M |
| 3,871,735 | 3/1975 | Herrmann | 339/177 R |
| 3,907,396 | 9/1975 | Huber | 339/103 R |
| 4,111,513 | 9/1978 | Thurston et al. | 339/143 R |

OTHER PUBLICATIONS

Hermaphroditic Connector, Evans, IBM Tech. Discl. Bull. vol. 16, No. 5, Oct. 1973, pp. 1505-1506.

*Primary Examiner*—Eugene F. Desmond
*Attorney, Agent, or Firm*—Russell J. Egan

[57] ABSTRACT

An electromagnetic shield is disclosed for use in combination with a standard connector to provide electromagnetic compatibility for the connector system. The shield includes a two part enclosure for a plug member, which enclosure is attached to the braided shielding of a cable and which requires no gasketing to provide complete shielding. A shroud is provided for a receptacle member and the two shields interfit in such manner as to obviate the need for further gasketing at the mating interface.

11 Claims, 8 Drawing Figures

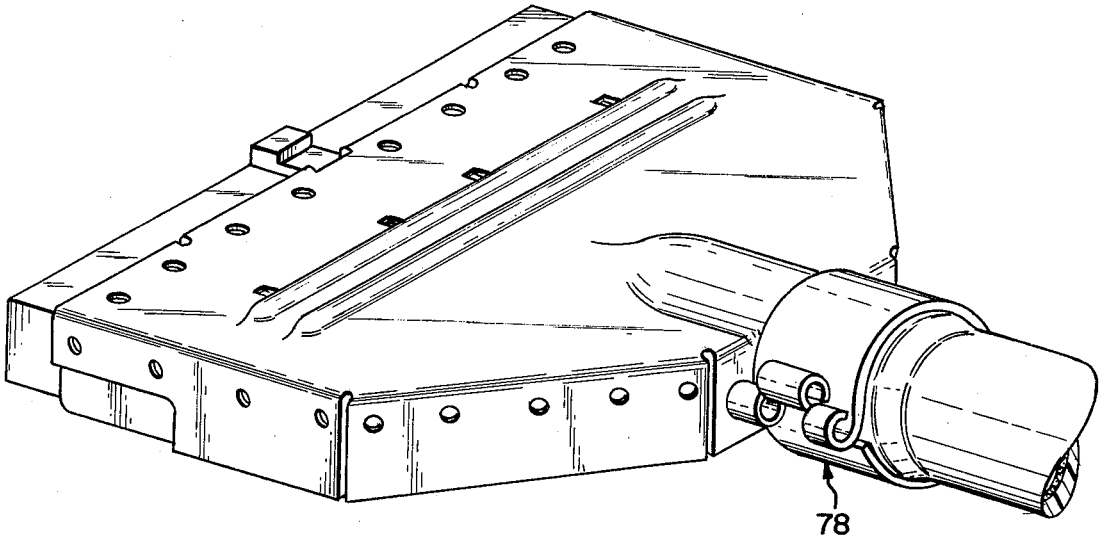
Fig. 7
Fig. 8
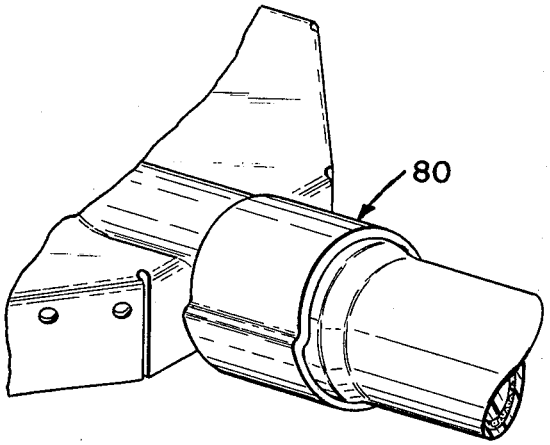

ELECTROMAGNETIC SHIELDED CONNECTOR

BACKGROUND OF THE INVENTION

1. The Field Of The Invention

The present invention relates to an electromagnetic shielded connector and in particular to the shield for use in combination with a standard connector to get a connecting system having electromagnetic compatability.

2. The Prior Art

Electromagnetic compatibility has been a concern in the electrical system design field for some time. Equipment must be designed so that it is neither a source of interference nor susceptible to external interferences. Both filtered connectors and shielded connectors are often required when electromagnetic compatibility is a strong design consideration. Significant work has been done in the past on military equipment to prevent electromagnetic interference by providing both filtered and shielded connectors. Electromagnetic compatibility is becoming of much more concern to equipment being developed for the commercial market place, for example computers. Three factors have contributed to the growing need for electromagnetic compatibility protection in this type of equipment:

(1) electrostatic discharges have been found to be of major concern in commercial computers since this type of discharge can seriously affect the operation of the computer equipment;

(2) ground loops resulting from equipment operating from different power outlets not only can adversely affect equipment operation, but it can also generate a potential safety hazard; and (3) the Federal Communication Commission has recently amended its rules governing electromagnetic interference emissions from equipment to include computer type systems.

When systems shielding is required for electromagnetic compatibility, connectors must also be shielded since they form an integral part of the total energy transfer link. The design considerations for connectors parallel those for general shielded enclosures. The connector must be surrounded with a metallic barrier with the amount of shielding offered by a particular metal depending upon many factors including thickness, conductivity, permeability, type of field, and the distance from the source to the field. Seams in the connector must be protected from leakage using good RF gasketing techniques. Since good metal to metal contact must be provided along the complete perimeter of the contact, mating surfaces must have surface treatment which will ensure good contact. The interface between the connector and cable shield must be designed to provide good peripherial contact. The separable interface between the plug and receptacle members must be designed to provide good peripherial contact. Also openings in the shell must be kept to a minimum and limited to size to prevent leakage.

Many of the shielded connectors on the market today usually have a heavy body which is cast in either a single piece or a two piece design. If a two piece design is used then a separate gasket is usually provided to seal the resulting seam. Some form of external back shell is then added to provide means for terminating the cable braid to the connector. The back shell usually consists of a number of separate parts resulting in an expensive addition to the connector. The separable connector interface is protected with another gasket which is either supplied separately or attached to one part of the connector. This approach results in a connector system which provides good shielding, however, it is usually expensive, difficult to assemble, and overall rather bulky in size and appearance.

The emerging need for shielded connectors in the commercial marketplace will demand devices which are inexpensive, easy to apply and still provide high levels of shielding effectiveness without being unduly cumbersome in size and configuration.

SUMMARY OF THE INVENTION

The present invention relates to an electromagnetic compatability accessory kit for a known electrical connector which requires no modification of the existing connector. The kit consists of two stamped and formed shells and a braid clamp for the one member and a shroud for the other member. The two shells comprise an outer and inner shell with the inner shell having a series of integral cantilever beams formed about most of its perimeter. The outer shell has a depending flange formed about its perimeter with a series spaced apertures formed in the flange. After the connector is terminated, it is placed in the inner shell and the outer shell is snapped in place over it. The integral cantilever beams on the inner shell provide a good peripherial contact without the need for a separable gasket. In addition, dimples on the ends of the beams fit into the apertures of the flange of the outer shell to lock the two shells together. The cable braid is then positioned over the rear of the connector and a clamp is installed to secure a good peripherial mechanical and electrical connection between the braid and the shield. The clamp can be replaced by a simple spring clip or by a crimp on annular member. The kit also includes a metal shroud which fits over the existing header. A plurality of individual cantilever beams are formed as an integral part of the shroud and folded upon themselves to lie inside the shroud about the mating face thereof. A separable interface is thus protected from leakage without the need for a separate gasket.

It is therefore an object of the present invention to produce an electromagnetic compatible connector system in which a metallic housing is provided for an existing connector with holes in the housing being kept to a minimum to eliminate leakage.

It is another object of the present invention to produce an inexpensive metallic housing for an existing electrical connector which housing can be plated with an inexpensive material to provide good surface treatment thereby assuring proper engagement without the need of separate gasketing.

It is still another object of the present invention to produce a kit which can be used to provide electromagnetic compatability with conventional electrical connectors. The kit including a mating pair of shells to enclose a plug member, a clamp to provide peripherial engagement between the shells and a braid of a cable and a shroud to enclose a receptacle portion.

It is a further object of the present invention to produce an electromagnetic shielding kit for use in combination with a conventional electrical connector and which kit can be readily and economically produced.

The means for accomplishing the foregoing objects and other advantages will become apparent to those skilled in the art from the following detailed description taken with reference to the accompanying drawings.

BRIEF DESCRIPTION OF THE DRAWINGS

FIG. 7 is a perspective showing an alternate clamping means for the subject invention; and FIG. 8 is a perspective showing a crimp ring to be used as a clamping means in combination with the present invention.

DETAILED DESCRIPTION OF THE PREFERRED EMBODIMENT

Figure 1:
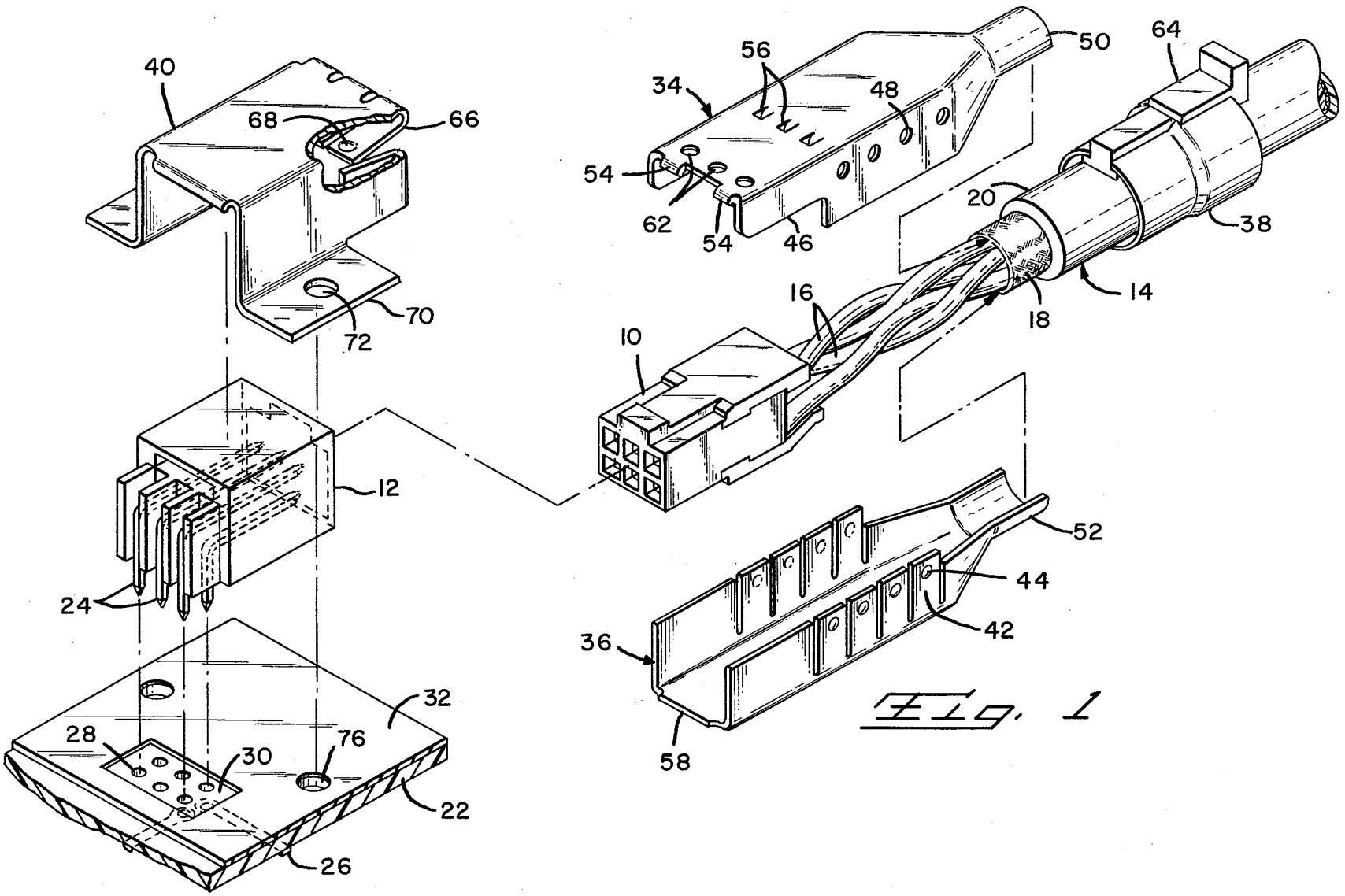
FIG. 1 is an exploded perspective view of the subject invention and a known electrical connector.

The subject electromagnetic shielding kit is shown in conjunction with a known connector system including a plug member 10 and a pin header or receptacle member 12. The plug is shown terminating a cable 14 with the individual insulated conductors 16 each being connected to an individual terminal (not shown) mounted in the plug member 10. The cable also includes a shielding braid 18 and an outer insulative jacket 20. The pin header 12 is mounted on a double sided printed circuit board 22 with pin terminals 24 engaging circuitry 26 on one side of the board through bores 28 and aperture 30 in a shielding layer 32 on the opposite side of the board.

Figure 6:
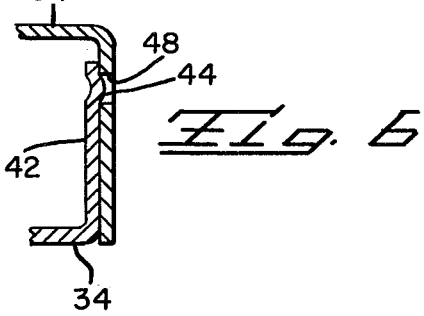
FIG. 6 is a detailed section view taken along line 6—6 of FIG. 3.

The subject electromagnetic shielding kit includes a pair of mating outer and inner shells 34, 36, respectively, a clamp 38 and a shroud 40. The inner shell 36 is profiled to receive the plug 10 and the cable 14 therein and includes a plurality of cantilevered beams 42 along the periphery with each beam having an outwardly directed dimple 44 spaced from the free end thereof. The outer shell 34 is likewise profiled to receive the plug 10, cable 14, and inner shell 36 therein and includes a peripherial flange 46 depending from all but the mating face and including a plurality of apertures 48 spaced therealong. The inner shell 36 is adapted to be received within the outer shell 34 with the cantilever beams 42 lying inside the flange 46 with the dimples 44 engaging in the respective apertures 48 as shown in FIG. 6. This serves to secure the shells together. The semi-cylindrical tail portions 50, 52 make a complete cylindrical cable enclosure which is received within the braid 18. The shells 34, 36 are each provided with inwardly directed plug positioning tines 54, 56, 58, 60. The outer shell 34 also has a series of apertures extending across and spaced from the edge of the mating face.

Figures 2, 3:
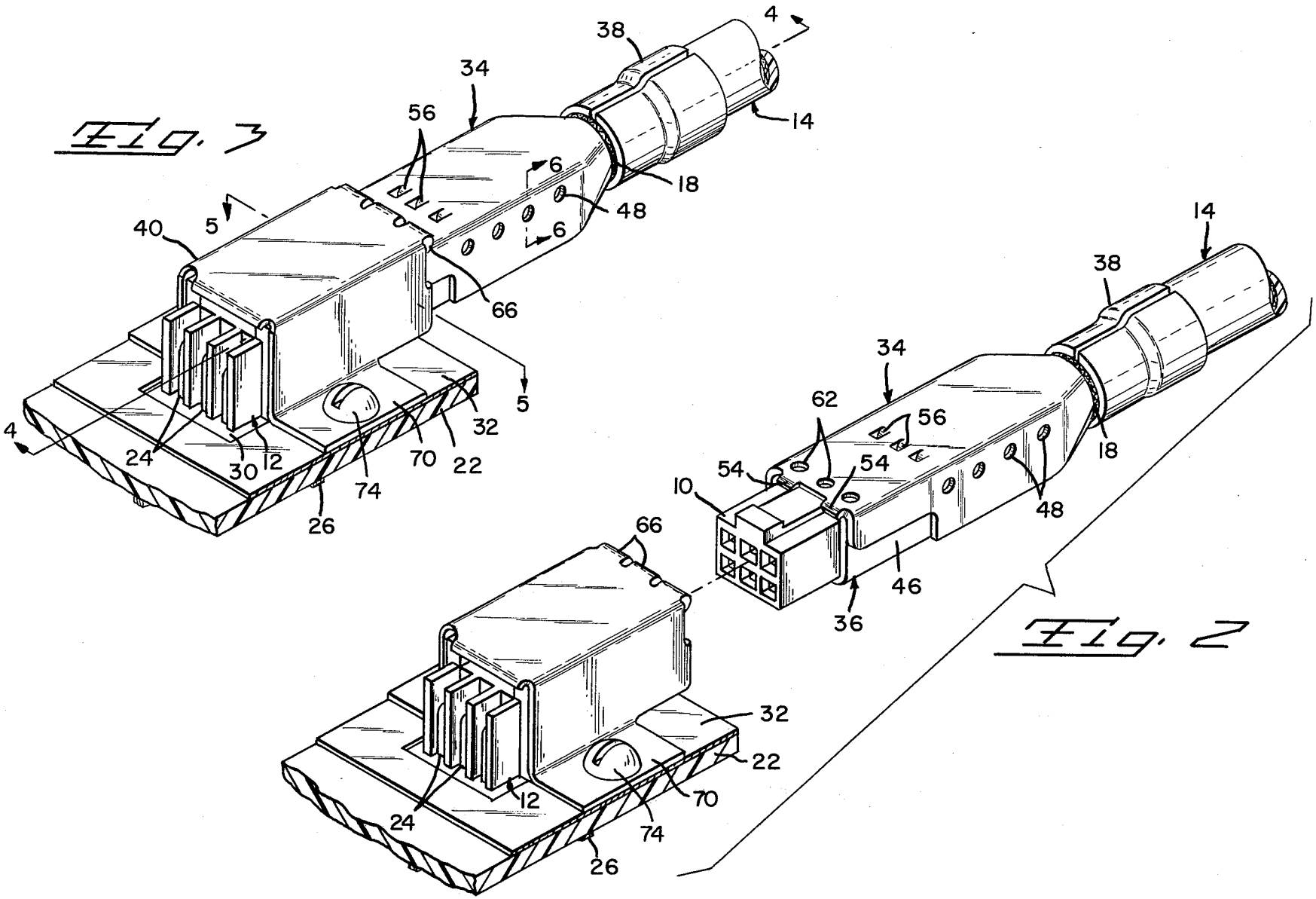
FIG. 2 is a perspective view of the invention in assembled about the connector and with the plug and receptacle members aligned for mating.
FIG. 3 is a perspective view of the connector of FIGS. 1 and 2 in a mated condition.

The clamp 38, which is initially held in a spread condition by the assembly tool 64 is moved longitudinally along the cable between the positions shown in FIGS. 1 and 2. When the tool 64 is removed, the clamp 38 contracts to tightly grip the cable 14 so that the braid 18 makes good mechanical and electrical connection with the tail portions 50, 52 of the shells 34, 36.

The shroud 40 is profiled to be received over the pin header 12 and is provided with a plurality of cantilever beams 66 about its mating end, the beams being folded upon themselves to lie within the shroud itself. Each beam 66 is provided with a dimple 68 spaced from the free end thereof. The shroud 40 is also provided with mounting flanges 70 having apertures 72 to receive bolts or the like 74 to pass through mounting apertures 76 secure the shroud 68 to the shielding layer 32 of the printed circuit board 22.

The subject shield kit is assembled as follows. First, a clamp 38 is placed on the cable and the connector then is terminated in the fashion required, for example, with the terminals being crimped onto the conductors 16 and loaded into the plug 10. The plug is then laid into the inner shell 36 with tines 58, 60 engaging shoulders, edges, recesses or the like to position the plug within the inner shell. The outer shell 34 is then assembled on the inner shell with engagement of dimples 44 in apertures 48 securing the shells together. The braid 18 is then slid forward to enclose the tail portions 50, 52. The tool 64 is in place to hold clamp 38 in a spread and therefore movable condition. The clamp is moved forward to cover the braid and tail portions and the tool 64 removed to release the clamp making a good electrical and mechanical engagement between the braid 18 and the shells 34, 36. The shroud is mounted on the pin header in the manner described above.

Figure 4:
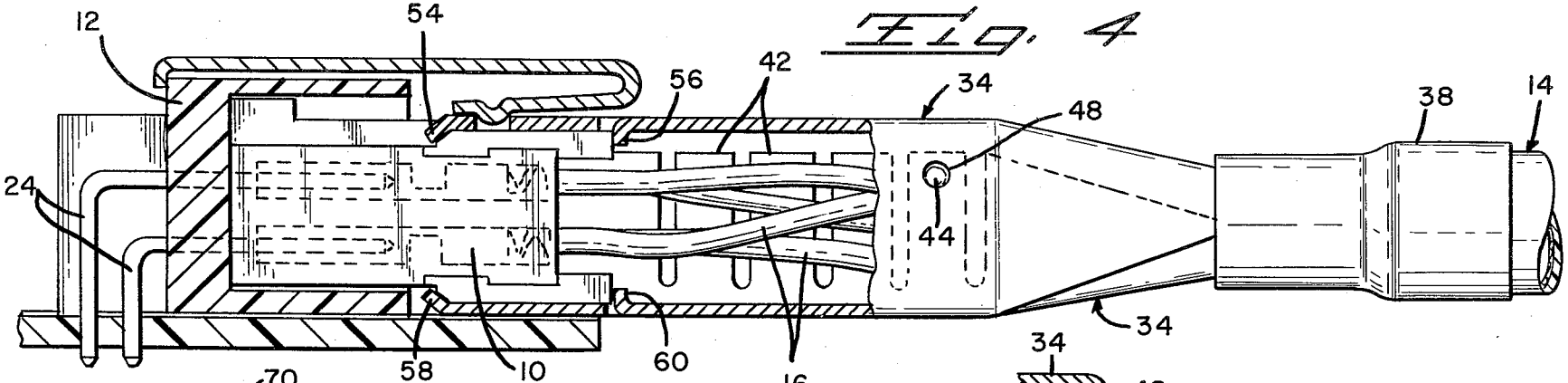
FIG. 4 is a side elevation, partially in section, taken along line 4—4 of FIG. 3.
Figure 5:
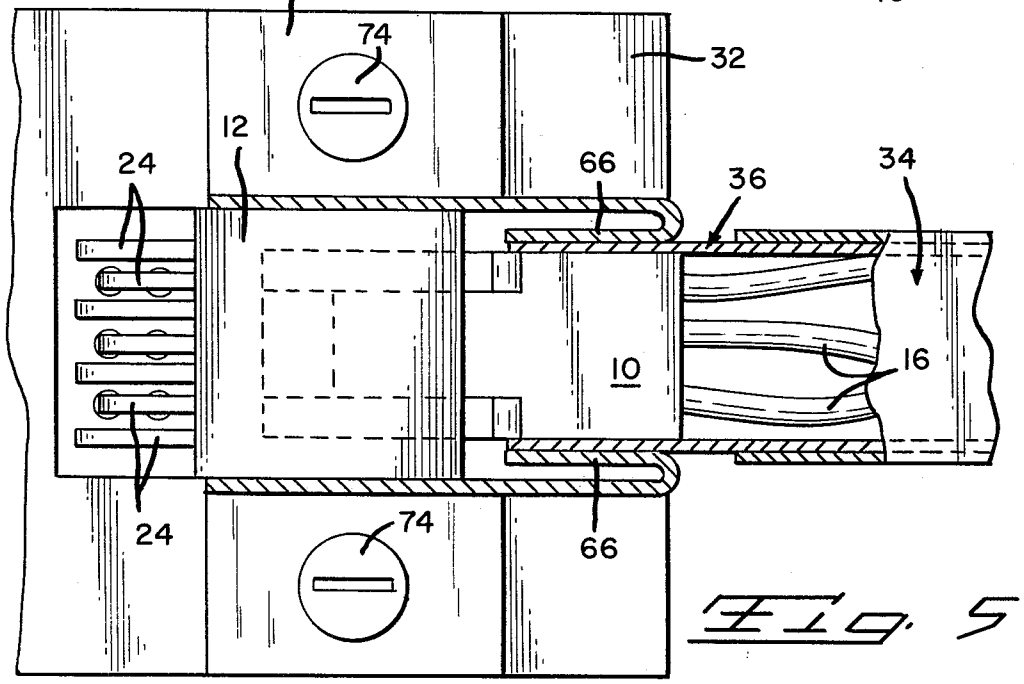
FIG. 5 is a plan view, partially in section, taken along line 5—5 of FIG. 3.

The shielded connector members are mated as shown in FIGS. 3, 4, and 5 with the shield shells 34, 36 interengaging with shroud 40 to form an entire metallic enclosure about the connector interface. The dimples 68 will engage in the apertures 62 to lock the connector members together.

The cable clamp 64 may be replaced by other known clamps including the spring clip 78 shown in FIG. 7 and the crimp ring 80 shown in FIG. 8 for effecting an interconnect between the braid 18 and the shells 34, 36. It should also be noted that the connector of FIG. 7 has a different profile than the previous connector. This is to illustrate the fact that the subject invention may be used with a wide variety of connectors of different sizes, shapes, and configurations.

The present invention may be subject to many modifications and changes without departing from the spirit or essential characteristics thereof. The present embodiment is therefore to be considered in all respects as illustrative and not restrictive of the scope of the invention.

What is claimed is:

1. In combination with an electrical connector having mating first and second members, a kit providing electromagnetic shielding for said connectors, said kit comprising:

a first enclosure formed by an intermating metallic inner first shell and outer second shells, said shell defining therebetween a cavity adapted to receive one of said connector members therein, each shell having a tail portion adapted to be received within a braided layer of shielded cable said inner first shell having a plurality of cantilever beams extending from a substantial portion of the periphery thereof and having an outwardly directed dimple spaced from the free end of each beam, said outer second shell having a flange depending from a like portion of the periphery thereof and adapted to receive said beams therein in interference fit, said flange also having an array of apertures spaced to each receive a respective dimple to secure said shells together, clamp means adapted to embrace said cable bringing said braided layer into good mechanical and electrical contact with said tail portions, and a second enclosure formed by a metallic shroud adapted to substantially enclose said second member and engage shielding associated therewith and the metallic shells of said first enclosure.

2. The kit according to claim 1 further comprising: inwardly directed tines on said shells adapted to engage said one connector member received therein to hold said one member in aligned position.

3. The kit according to claim 1 wherein said second connector member is a pin header and said second enclosure metallic shroud defines an entry, a plurality of cantilever beams extending from said shroud about said entry, each said beam being folded upon itself to lie within said shroud.

4. The kit according to claim 3 further comprising: means to mount said shroud about said pin header.

5. The kit according to claim 3 further comprising:

a dimple on each said folded beam adjacent the free end thereof, and a like number of apertures in one of said shells whereby, upon mating, said dimples are received within said apertures to secure said members together.

6. The kit according to claim 1 wherein said clamp means is a split cylinder of a diameter less than that of said cable, whereby when placed over said cable it will exert a radial force over substantially the entire periphery thereof.

7. The kit according to claim 1 wherein said clamp means is an annular spring.

8. The kit according to claim 1 wherein said clamp means is an annular crimp ring.

9. Means to provide electromagnetic shielding to a conventional electrical connector having two mating pieces, said means comprising:

a first metallic enclosure for a first one of said connector members, said first enclosure having mating inner and outer shell members each with semicylindrical tail portions adapted to be received within a shielding portion of a shielded cable said inner shell having a plurality of cantilever beams about a substantial portion of the periphery thereof, each beam having an outwardly directed dimple adjacent the free end thereof, said outer shell having a flange depending from a substantial portion of the periphery thereof with a like plurality of apertures each spaced to receive a respective dimple therein to hold said shells together, clamp means adapted to apply compressive force to said cable creating good electrical and mechanical connection between a cable shielding portion and said tail portions; and a second metallic enclosure adapted to enclose a second one of said connector members therein and to receive said first member and first enclosure in mating relationship, said second enclosure engaging shielding associated with said second member as well as said first enclosure.

10. The means according to claim 9 wherein said second one of said connector members is a pin header and said second metallic enclosure is a shroud.

11. The means according to claim 9 wherein said clamp means is a split cylinder of a diameter less than that of said cable whereby peripheral radial force is exerted.

* * * * *